US008522460B2

(12) United States Patent
Stewart

(10) Patent No.: US 8,522,460 B2
(45) Date of Patent: Sep. 3, 2013

(54) UNDERWATER EXCAVATION APPARATUS

(75) Inventor: Donald Stewart, Munlochy (GB)

(73) Assignee: Rotech Holdings Limited, Aberdeen (GB)

( * ) Notice: Subject to any disclaimer, the term of this patent is extended or adjusted under 35 U.S.C. 154(b) by 340 days.

(21) Appl. No.: 12/990,545

(22) PCT Filed: Apr. 30, 2009

(86) PCT No.: PCT/GB2009/001102

§ 371 (c)(1),
(2), (4) Date: Nov. 23, 2010

(87) PCT Pub. No.: WO2009/133373

PCT Pub. Date: Nov. 5, 2009

(65) Prior Publication Data

US 2011/0056098 A1 Mar. 10, 2011

(30) Foreign Application Priority Data

May 1, 2008 (GB) ..... 0807969.1

(51) Int. Cl.
*E02F 3/88* (2006.01)
*E02F 3/00* (2006.01)

(52) U.S. Cl.
USPC ..... 37/323; 37/344

(58) Field of Classification Search
USPC ..... 37/309–317, 322, 323, 318, 195, 37/344; 175/66, 67, 424; 406/88, 96, 157–162; 405/163
See application file for complete search history.

(56) References Cited

U.S. PATENT DOCUMENTS

| | | | | |
|---|---|---|---|---|
| 4,165,571 | A | 8/1979 | Chang et al. | |
| 4,322,897 | A * | 4/1982 | Brassfield | 37/322 |
| 4,479,741 | A | 10/1984 | Berti et al. | |
| 4,839,061 | A * | 6/1989 | Manchak, Jr. et al. | 210/743 |
| 4,914,841 | A * | 4/1990 | Weinrib | 37/195 |
| 4,932,144 | A | 6/1990 | Sills | |
| 5,970,635 | A * | 10/1999 | Wilmoth | 37/323 |

(Continued)

FOREIGN PATENT DOCUMENTS

| | | |
|---|---|---|
| DE | 19942472 A1 | 4/2001 |
| EP | 0072172 A1 | 2/1983 |

(Continued)

OTHER PUBLICATIONS

Meyer-Nehls "Das Wasserinjektionsverfahren", *Ergebnisse Aus Dem Baggergutuntersuchungsprogramm* pp. 1-110 (2000).

(Continued)

*Primary Examiner* — Robert Pezzuto
(74) *Attorney, Agent, or Firm* — Myers Bigel Sibley & Sajovec, P.A.

(57) ABSTRACT

The present invention relates to an underwater excavation apparatus. The apparatus of the invention utilizes mass flow for disturbing or excavating an underwater location and for extracting or sucking excavated material from the underwater location to another location. Restriction of spoil and/or direct spoil is provided for the apparatus and comprises a baffle provided within a cavity of a housing having an open base for the extracting or sucking of excavated material. An outlet for disturbing or excavating and an inlet for extraction or suction are located within the housing while an inlet for disturbing or excavating and an outlet for extraction or suction are located external to the housing.

49 Claims, 9 Drawing Sheets

(56) References Cited

U.S. PATENT DOCUMENTS

| | | | | |
|---|---|---|---|---|
| 6,470,605 | B1 * | 10/2002 | Gilman et al. | 37/323 |
| 7,395,618 | B2 * | 7/2008 | Jacobsen et al. | 37/313 |
| 2007/0166107 | A1 | 7/2007 | Jacobsen et al. | |

FOREIGN PATENT DOCUMENTS

| | | | |
|---|---|---|---|
| EP | 0119653 | A1 | 9/1984 |
| EP | 1584754 | A1 | 10/2005 |
| GB | 2359101 | A | 8/2001 |
| GB | 2362404 | A | 11/2001 |
| GB | 2444259 | A | 5/2008 |
| JP | 2248535 | A | 10/1990 |
| WO | WO 87/04743 | A1 | 8/1987 |
| WO | WO 99/07949 | A1 | 2/1999 |
| WO | WO 01/14649 | A1 | 3/2001 |
| WO | WO 02/090667 | A1 | 11/2002 |
| WO | WO 03/099093 | A1 | 12/2003 |
| WO | WO 03/102313 | A1 | 12/2003 |
| WO | WO 2004/065700 | A1 | 8/2004 |
| WO | WO 2004/106643 | A2 | 12/2004 |
| WO | WO 2006/036070 | A1 | 4/2006 |

OTHER PUBLICATIONS

De Keizer et al. "A New Generation DpDt System for Dredging Vessels", *Dynamic Positioning.Conference* pp. 1-13 (2000).
International Search Report corresponding to PCT/GB2009/001102 mailed Feb. 15, 2010.
Search Report corresponding to GB 0807969.1 dated Jun. 11, 2008.

* cited by examiner

UNDERWATER EXCAVATION APPARATUS

RELATED APPLICATIONS

The present application is a 35 U.S.C. §371 national phase application of PCT International Application No, PCT/GB2009/01102, having an international filing date of Apr. 30, 2009, claiming priority to Great Britain Patent Application No. 0807969.1, filed May 1, 2008. The disclosures of each application are incorporated herein by reference in their entireties. The above PCT International Application was published in the English language as International Publication No. WO 2009/133373A2.

FIELD OF INVENTION

This invention relates to an improved excavation apparatus, device or tool, and in particular, though not exclusively, to an improved underwater excavation apparatus, device or tool. The invention also relates to an improved excavation system comprising such an excavation apparatus, and to a method of underwater excavation, e.g. using such an excavation apparatus.

The invention also relates to an improved underwater subsea mass flow excavation apparatus, device or tool, to a related excavation system comprising means for removing spoil, and to a related method of underwater or subsea excavation.

BACKGROUND TO INVENTION

Herein by "underwater" is meant below or under a surface of a body of water, whether moving or static, natural or man-made, e.g. a sea bed, ocean floor, river bed, canal bottom, lake or loch floor, dam floor, or the like. However, the invention finds particular use in seas or oceans.

"Mass flow" excavators operate by directing a flow of high volume fluid under low pressure at the sea bed or at a subsea structure or surface to displace material such as sea bed material. This is in contradistinction to "jet" type apparatus which direct a flow of low volume fluid under high pressure at the sea bed. "Mass flow" and "jet" or "jetting" are therefore distinct terms, known in the art. In terms of differences between mass flow excavators and jetting excavators, in mass flow (as the name suggests) it is the mass or volume of flow which moves or removes material. In jetting it is the speed, and thus pressure of the jets which does the cutting. In jetting pressures can be of the order of 3,000 psi ($2.07\times10^7$ Pa), whereas mass flow excavators typically operate at pressures in the order of 10 to 20 psi ($6.89\times10^4$ to $1.37\times10^5$ Pa).

It will appreciated that power is a function of pressure and flow rate. Therefore, for a given available power in order to transfer power from the device into seawater and into the soil to be disturbed, it is possible to select high flow rate and low pressure (i.e. mass flow) or to select high pressure and low flow rate (i.e. jetting).

A mass flow excavator is typically tethered from a vessel by means of a crane wire, which is used to lower and retrieve the excavator, and to maintain a given distance from the sea bed or structure or object requiring excavation, such as a subsea oil or gas pipeline. In order to control the excavator, sonar detection means can be used to allow the excavator operator to view the excavation in real time. Cameras and metal detection means can also be used to assist the operator.

Underwater mass flow excavation apparatus are known. For example, GB 2 297 777 A and WO 98/027286, also by the present Applicant (Assignee), the content of which is incorporated herein by reference.

Mass flow excavation is a means of creating cavities in the sea bed or deburying objects. In the trade of mass flow excavation it is accepted that excavated material is spread in a circular manner around the cavity. The material is displaced to a distance far enough to retain depth of the created cavity. There are, however, limits to the distance to which the material can be thrown, which then limits the size and depth of the cavity to be created. Current applications of mass flow excavation are restricted to those excavations which do not require the sea bed material to be excavated, collected and deposited in a particular area, such as is required for excavation of harbour areas or canals, where it is important that the excavated material is removed to particular locations.

The present Inventor has identified that where the excavation requires a large cavity to be created, in order to overcome this limitation in mass flow excavators a means is required to collect and carry the excavated material through a duct means away from the excavated cavity. The distance by or over which the material requires to be carried is determined by the size of the cavity to be created.

US 2007166107 (JACOBSEN et al) discloses a subsea excavation and suction device which includes a suction head with an inlet opening at an outer, free end and an outlet opening connected to a suction hose arranged at a distance from the inlet opening. The suction head is mounted on a hydraulic controller arm and has at the inlet opening provided with mechanical and hydraulic means to disintegrate solid material (sediment). The hydraulic means includes a number of jet nozzles, while the mechanical means includes bars. The cross-sectional area of the inlet opening is larger than the cross-sectional area of the outlet opening.

U.S. Pat. No. 4,479,741 A (BERTI et al) discloses a self-propelling device for burying and digging up subsea conduits laid on beds of an incoherent material. The device has: disintegrating members using high pressure water jets to create a slurry of material; digging members having suction members which draw the suspension prepared by the disintegrating members, thus leaving a trench behind; and displacement members for moving the device on the sea bed astride the conduit.

EP 1 857 598 A1 (IHC HOLLAND IE) discloses a suction dredger comprising a dredging tube which at one end carries a suction head and which at the other end is connected to the suction dredger hull through a hull pivot with a pivot axis which is generally transverse with respect to said hull.

www.toyopumpseurope.com/toyo exca.html discloses a submersible excavator having a mechanical agitator.

The above apparatus are mechanically complex and provide a slow means of excavation in comparison to their relative expense.

It is an object of at least one embodiment of at least one aspect of the present invention to seek to obviate or at least mitigate one or more of the aforementioned problems in the prior art.

It is an object of at least one embodiment of at least one aspect of the present invention to seek to obviate or at least mitigate one or more problems in the prior art.

It is an object of at least one embodiment of at least one aspect of the present invention to provide a means to effect a desire for excavating a location or "deburying" an object and optionally for collecting and transporting excavated material in a rapid and comparatively inexpensive manner.

SUMMARY OF INVENTION

One or more objects of the present invention are sought to be addressed by providing the general solution of an underwater excavation apparatus comprising:

means for disturbing or excavating an underwater location, such as a sea bed, ocean floor or river bed;

means for extracting or sucking excavated material from the location to another location.

According to a first aspect of the present invention there is provided an apparatus, device or tool, such as and beneficially an excavation apparatus, device or tool, such as and more beneficially an underwater excavation apparatus or tool, the apparatus or tool comprising:

at least one and preferably one mass flow excavation means; and at least one and preferably one suction or collection means.

The term "mass flow" used herein is a known term of art, distinguished from "jetting" as hereinbefore explained.

The mass flow means may comprise means for blowing or directing fluid, e.g. at a predetermined or selected location to be excavated.

The mass flow or fluid may comprise underwater fluid, e.g. from the body of water, e.g. sea water, under or within which the location is positioned.

The mass flow means may disturb or disrupt material(s) at and/or around the location.

The disrupted material(s) may be referred to as, or comprise spoil.

The apparatus or tool may comprise means for restricting spoil or directing spoil to the suction means.

The apparatus or tool may comprise a baffle or hood. The baffle or hood may comprise the means for restricting and/or directly spoil.

The apparatus or tool may comprise a housing, enclosure or cowling, which may comprise or define a space or cavity.

The housing, enclosure or cowling may comprise a closed top which may comprise the baffle or hood.

The housing, enclosure or cowling may be made from a sheet material, e.g. sheet metal. The housing, enclosure or cowling may comprise a skeleton or frame.

The housing, enclosure or cowling may comprise an access means, e.g. hatch or door, e.g. in a side wall thereof. Such access means may allow access to the space or cavity, e.g. for maintenance.

The housing may be rectilinear or domed. The space may be rectilinear. This arrangement is believed to be advantageous.

The housing may comprise a wall or walls or skirt which may depend downwardly from a top.

The housing may comprise a base which may be at least partly open. In this way the housing may be positioned, in use, such that the housing may rest on or above the location and spoil may be removed from the location via the base into the space or cavity by the action of the mass flow excavation means.

The housing may comprise a planar, e.g. substantially rectangular, top. The housing may comprise a planar, e.g. substantially rectangular, base. The top may, in use, be positioned above the base. The top may be smaller than the base. This may make the housing more stable, in use. The housing may comprise first and second opposing side walls, which may taper (e.g. outwardly) from the top to the base. The housing may comprise third and fourth opposing side walls, which may depend substantially vertically between the top and the base. The first and second side walls may be bigger than the third and fourth side walls.

In use, a direction of intended movement of the apparatus, device or tool may be substantially parallel to a longitudinal axis of the first and second side walls. In use, a direction of intended movement of the apparatus, device, or tool may be substantially parallel to the top and the base.

In use, a direction of intended movement of the apparatus, device or tool may be substantially perpendicular to the third and fourth side walls.

The apparatus or tool may comprise means for moving the apparatus substantially vertically and/or means for moving the apparatus substantially horizontally.

An inlet of the mass flow excavation means may be located external of or at least communicable with external of the housing. An outlet of the mass flow means may be located internal of or at least communicable with internal of the housing, e.g. within the space. The outlet of the mass flow means may be provided in a lower portion of the space.

An inlet of the suction means may be located internal of or at least communicable with internal of the housing. An outlet of the suction means may be located external of or at least communicable with external of the housing, e.g. within the space.

The outlet of the mass flow means may be nearer the base than the inlet of the suction means.

A screen or filter may be provided between the mass flow excavation means and the suction means, e.g. between an outlet from the mass flow excavation means and an inlet of or to the suction means.

A face or side of the screen or filter closer to the mass flow excavation means may face at least partially downward or be inclined towards the base.

The apparatus may comprise means for facilitating movement of the apparatus such as skis, skids or runners, which may be provided on the housing, e.g. at, on, or adjacent the base.

The mass flow excavation means may be substantially vertically disposed, e.g. on the top of the housing.

In one embodiment the suction means may be substantially horizontally disposed, e.g. on a side of the housing, e.g. on one of the third or fourth side walls.

In an alternative embodiment the suction means may be substantially vertically disposed, e.g. on the top of the housing.

The mass flow excavation means may comprise a hollow body (e.g. cylindrical body) having an inlet and an outlet, at least one impeller rotatably mounted in the hollow body and means for driving the at least one impeller. The mass flow excavation means hollow body may be mounted through the housing.

An inner diameter ("nozzle") diameter of at least the outlet of the mass flow excavation means of the hollow body may be at least 450 mm, or 660 mm or greater.

In one implementation the mass flow excavation means may comprise a device comprising a hollow body having an inlet and an outlet, at least one pair of impellers coaxially displaced one from the other and rotatably mounted in the hollow body and means for driving the impellers of the/each pair in contrary rotating or contra-rotating directions. Such a device is disclosed in GB 2 297 777 A, the content of which is incorporated herein by reference.

The inlet and outlet of the hollow body may be provided at opposing ends thereof, the common axis of the impellers extending between the inlet and the outlet.

The means for driving the impellers may comprise a motor.

The motor may be selected from one of a "Moineau", a hydraulic or an electric motor.

In another implementation the mass flow excavation means may comprise a hollow body having at least two inlets and at least one outlet, at least one pair of impellers rotatably mounted in the hollow body, and means for driving the impellers, wherein the at least two inlets are substantially symmetrically disposed around an axis extending from the at least one outlet. Such a device is disclosed in EP 1 007 796 B1, the content of which is incorporated herein by reference.

The driving means may cause the impellers to be driven in contrary rotating or contra-rotating directions.

One of the impellers may be provided within one of the inlets and another of the impellers may be provided within another of the inlets. There may be provided one pair of inlets.

The mass flow means may comprise a pair of horizontally opposed inlets communicating with a single outlet, the outlet being disposed substantially midway between, and preferably perpendicular the two inlets, in use, such that the means is substantially "T" shaped in profile.

Alternatively the mass flow means may comprise a pair of inlets communicating with a single outlet, the inlets being substantially symmetrically disposed around an axis extending from the outlet, the outlet being disposed vertically downwards substantially midway between the two inlets, in use, such that the means is substantially "Y" shaped in profile.

An/the at least one impeller may be provided within each outlet.

The/each suction means may comprise a hollow body (e.g. cylindrical body) having an inlet and an outlet, at least one impeller rotatably mounted in the hollow body and means for driving the at least one impeller. The suction means hollow body may be mounted through the housing.

An inner ("nozzle") diameter of at least the outlet of the suction means hollow body may be at least 450 mm, or may be 600 mm, or greater.

The/each suction means may be of a substantially similar or same structure to the mass flow excavation means. The suction means may comprise a further mass flow means.

In one implementation the suction means may comprise a device comprising a hollow body having an inlet and an outlet, at least one pair of impellers coaxially displaced one from the other and rotatably mounted in the hollow body and means for driving the impellers of the/each pair in contrary rotating or contra rotating directions.

The inlet and outlet of the hollow body may be provided at opposing ends thereof, the common axis of the impellers extending between the inlet and the outlet.

The means for driving the impellers may comprise a motor.

The motor may be selected from one of a "Moineau" motor, a hydraulic motor, or an electric motor.

In another implementation the suction means may comprise a hollow body having at least two inlets and at least one outlet, at least one pair of impellers rotatably mounted in the hollow body, and means for driving the impellers, wherein the at least two inlets are substantially symmetrically disposed around an axis extending from the at least one outlet.

The driving means may cause the impellers to be driven in contrary or contra-rotating directions.

One of the impellers may be provided within one of the inlets and another of the impellers may be provided within another of the inlets.

There may be provided one pair of inlets.

The suction means may comprise a pair of horizontally opposed inlets communicating with a single outlet, the outlet being disposed substantially midway between and preferably perpendicular to the two inlets, in use, such that the means is substantially "T" shaped in profile.

Alternatively the suction means may comprise a pair of inlets communicating with a single outlet, the inlets being substantially symmetrically disposed around an axis extending from the outlet, the outlet being disposed substantially midway between the two inlets, in use, such that the means is substantially "Y" shaped in profile.

An/the at least one impeller may be provided within each outlet.

Preferably, in use, the suction means may act or operates at a higher (mass) flow rate than the mass flow excavation means.

In a beneficial implementation the suction means may operate at approximately double the flow rate of the mass flow excavation means.

A mass flow rate of the mass flow excavation means may be at least 2,000 litres/second, and typically in the range of 2,000 to 16,000 litres/second.

A mass flow rate of the suction means may be at least 2,000 litres/second, and typically in the range of 2,000 to 16,000 litres/second.

Preferably, in use, a pressure of the flow from the mass flow means may be less than 100 psi ($6.89\times10^5$ Pa), preferably less than 50 psi ($3.44\times10^5$ Pa), preferably in the range 5 to 25 psi ($3.44\times10^4$ to $1.72\times10^5$ Pa), and most preferably, in the range 10 to 20 psi ($6.89\times10^4$ Pa to $1.37\times10^5$ Pa).

Preferably, in use, a pressure of flow into the suction means may be less than 100 psi ($6.89\times10^5$ Pa), preferably less than 50 psi ($3.44\times10^5$), preferably in the range 5 to 25 psi ($3.44\times10^4$ to $1.72\times10^5$ Pa), and most preferably in the range 10 to 20 psi ($6.89\times10^4$ to $1.37\times10^5$ Pa).

Preferably, in use, the action of the mass flow excavation means acts to reduce a size of spoil or distributed material, e.g. particulate thereof.

In a preferred implementation wherein the apparatus comprises a/the hood or housing and a/the filter or screen, in use, the mass flow excavation means may disturb and cause recirculation and reduction in size of spoil or disturbed material within the hood or housing. This may act to seek to make spoil or disturbed material small enough to pass through the screen or filter, and preferably of a maximum predetermined size to make the spoil suitable for transportation along a transport means.

The housing may be rectilinear or domed. The space may be rectilinear or domed. The latter may be of benefit to recirculation.

In a modification, the housing may be provided with means to at least partially fit over at least a portion of a pipe, pipeline, or tubular to be or which is being excavated or deburied.

The means for fitting over may be provided with sealing means. The sealing means may act to seal between the housing and the pipe, pipeline, or tubular, in use. The sealing means may be elastomeric.

For example, suitably shaped apertures may be provided in the third or fourth side walls of the housing. The apertures may be transversely aligned with one another. The apertures may extend from the base of the housing. The apertures may be substantially U-shaped.

This arrangement may allow the housing to be moved along the pipe as excavation or deburying thereof progresses, in use.

At least a portion of a/the transportation means or pipe may be trailed rearward of a direction of movement of the housing, in use.

According to a second aspect of the present invention there is provided a system, such as an excavation system, such as an underwater excavation system, comprising:

at least one apparatus according to the first aspect or general solution of the invention; and means for transporting spoil from the suction means to a remote location.

The transport means may comprise a pipe or hose. The hose may be a collapsible or a lay flat hose.

The transport means may comprise at least one further suction means positioned along the transport means, e.g. in series with the suction means.

In one implementation the remote location may comprise a location on the sea bed, ocean floor or river bed, e.g. below the level of the location being excavated. This is particularly beneficial in seeking to obviate or mitigate refilling of the excavated location.

Alternatively, the remote location may comprise an above surface location or a vessel, e.g. surface vessel, e.g. boat, ship, barge or hopper.

An inlet of the transport means may communicate with an outlet of the suction means.

An outlet of the transport means may communicate to or with the remote location.

According to a third aspect of the present invention there is provided a method of excavating a location, such as an underwater location, comprising:

providing a system according to the second aspect of the present invention; using the system to move material from the location to a remote location.

According to a fourth aspect of the present invention there is provided a combination of a mass flow excavator and a suction means.

Optionally and beneficially the combination comprises an enclosure or housing.

According to a fifth aspect of the present invention there is provided an apparatus, device, or tool, such as an excavation apparatus, device, or tool, such as an underwater excavation apparatus, device, or tool comprising:

a first mass flow means; and a second mass flow means.

The first mass flow means may direct or cause flow, e.g. of fluid, towards a location to be excavated.

The second mass flow means may direct or cause flow, e.g. of spoil, away from the location and/or adjacent the location.

The apparatus or tool may comprise a housing.

The first mass flow means may be a "blowing" means.

The second mass flow means may be a "sucking" means.

According to a sixth aspect of the present invention there is provided a method of excavating an underwater location comprising:

surveying the location;

excavating the location.

The step of surveying the location may comprise dividing the location and the environs thereof (or surrounding area) into a plurality of sectors, e.g. grid sectors.

The step of surveying may also comprise establishing a height, e.g. an average height, of a surface or position, e.g. below a surface of a body of water, such as a sea bed, ocean floor, lake bed, or river bed, or the like within at least a sector in which the location lies and at least one and preferably a plurality of another sector(s). Preferably the step of surveying comprises selecting one of the another sectors distal or remote from the location sector, e.g. not adjacent thereto, which (one) another sector has a lower height (at least average height) than a height (at least average height) the location sector. In other words, the another sector may be at least on average deeper below sea level, or below a surface of a body of water than the location sector.

Preferably also the step of selecting the one another sector comprises selecting the another sector dependent upon said another sector being in a downstream disposition or diagonally downstream disposition of the location sector in one tidal stream direction.

The method may also comprise providing an excavation apparatus, and preferably excavating the location with the excavation apparatus.

The excavation apparatus may comprise an excavation apparatus, device, tool or system according to any preceding general solution or aspect of the present invention.

The step of excavating the location may comprise using the excavation apparatus to remove material or spoil from the location sector to the selected another sector.

The method may comprise repeating the steps of the method for a plurality of locations in a plurality of sectors. In such case, each another location may be different and/or the same.

BRIEF DESCRIPTION OF DRAWINGS

Embodiments of the invention will now be described by way of example only, and with reference to the accompanying drawings, which are.

DETAILED DESCRIPTION OF DRAWINGS

Figure 1:
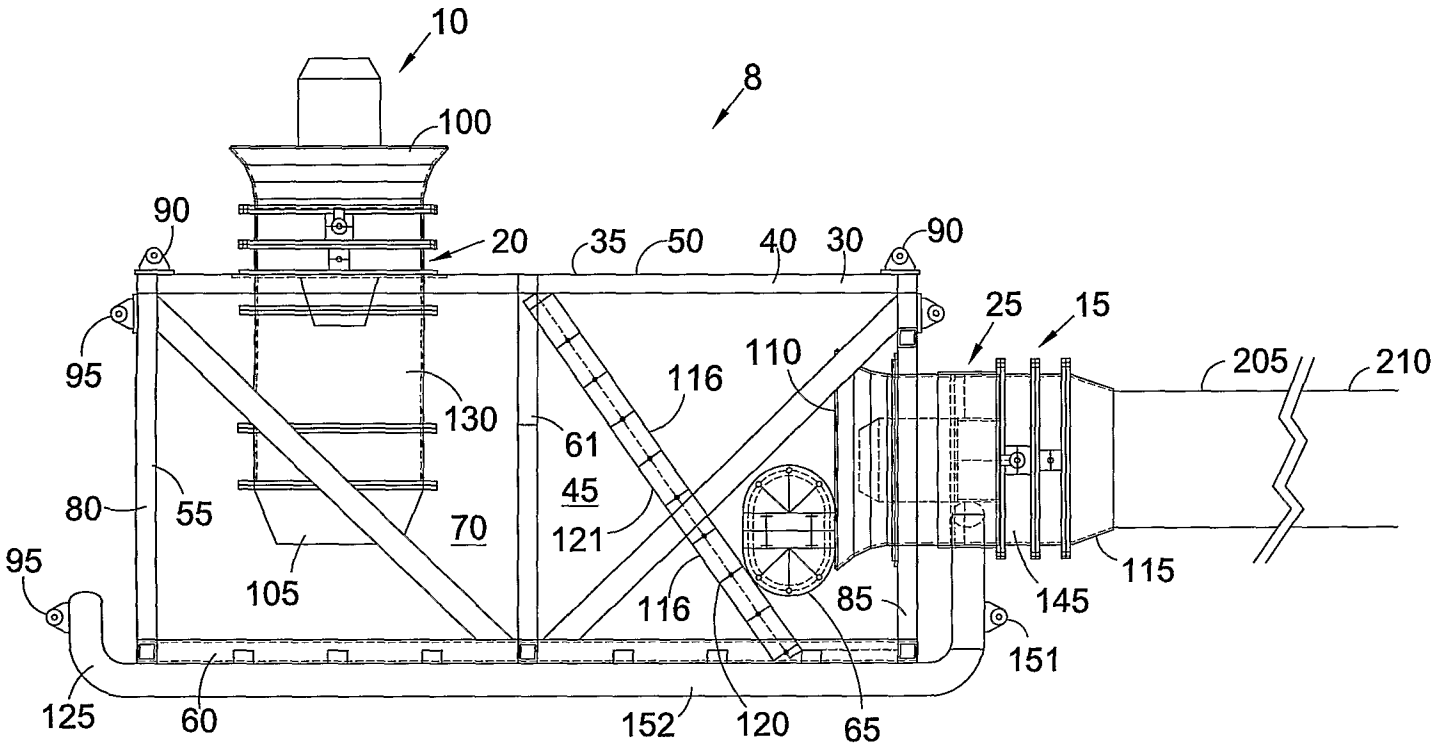
FIG. 1 a partial cross-sectional side view of an excavation apparatus according to a first embodiment of the present invention.
Figure 2:
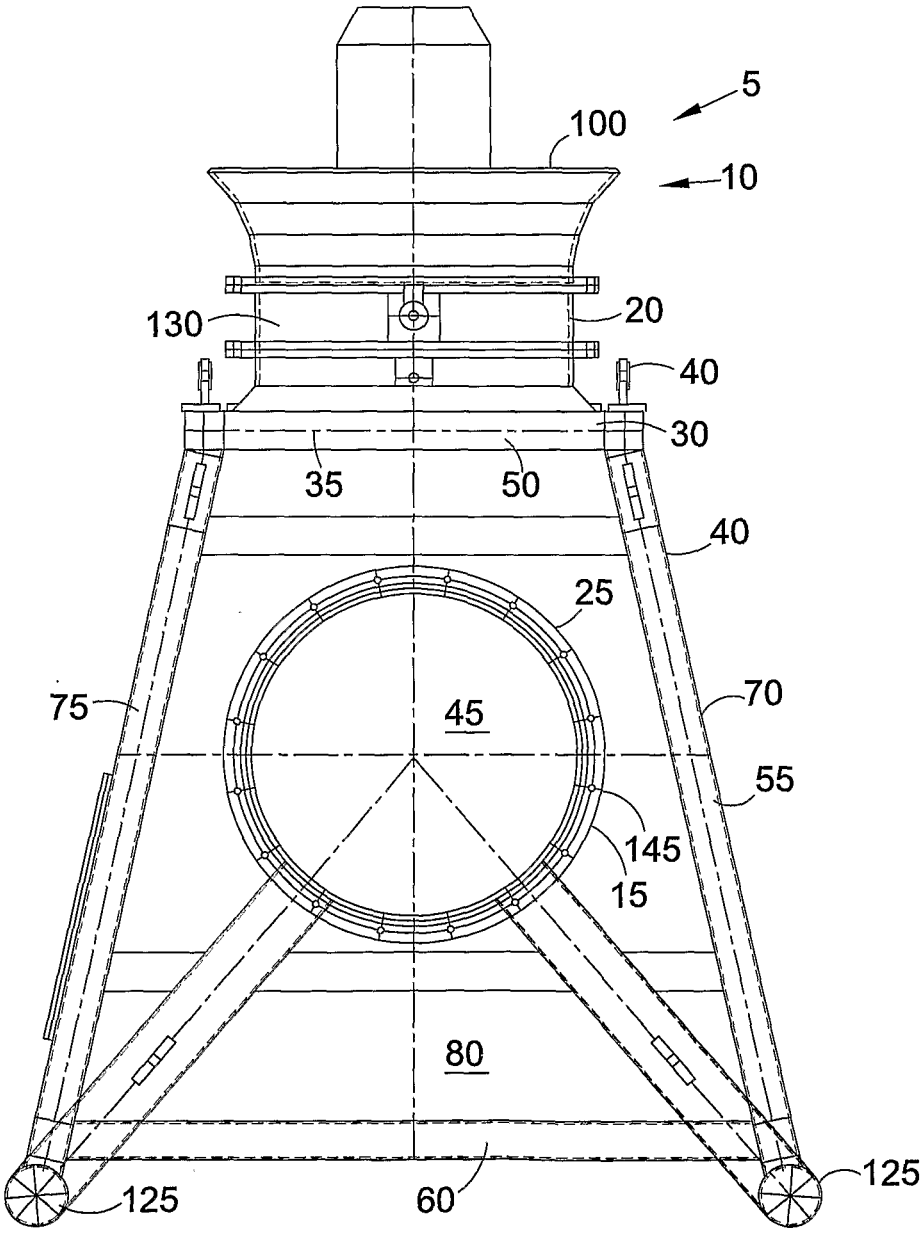
FIG. 2 an end view of the excavation apparatus of FIG. 1.
Figure 3:
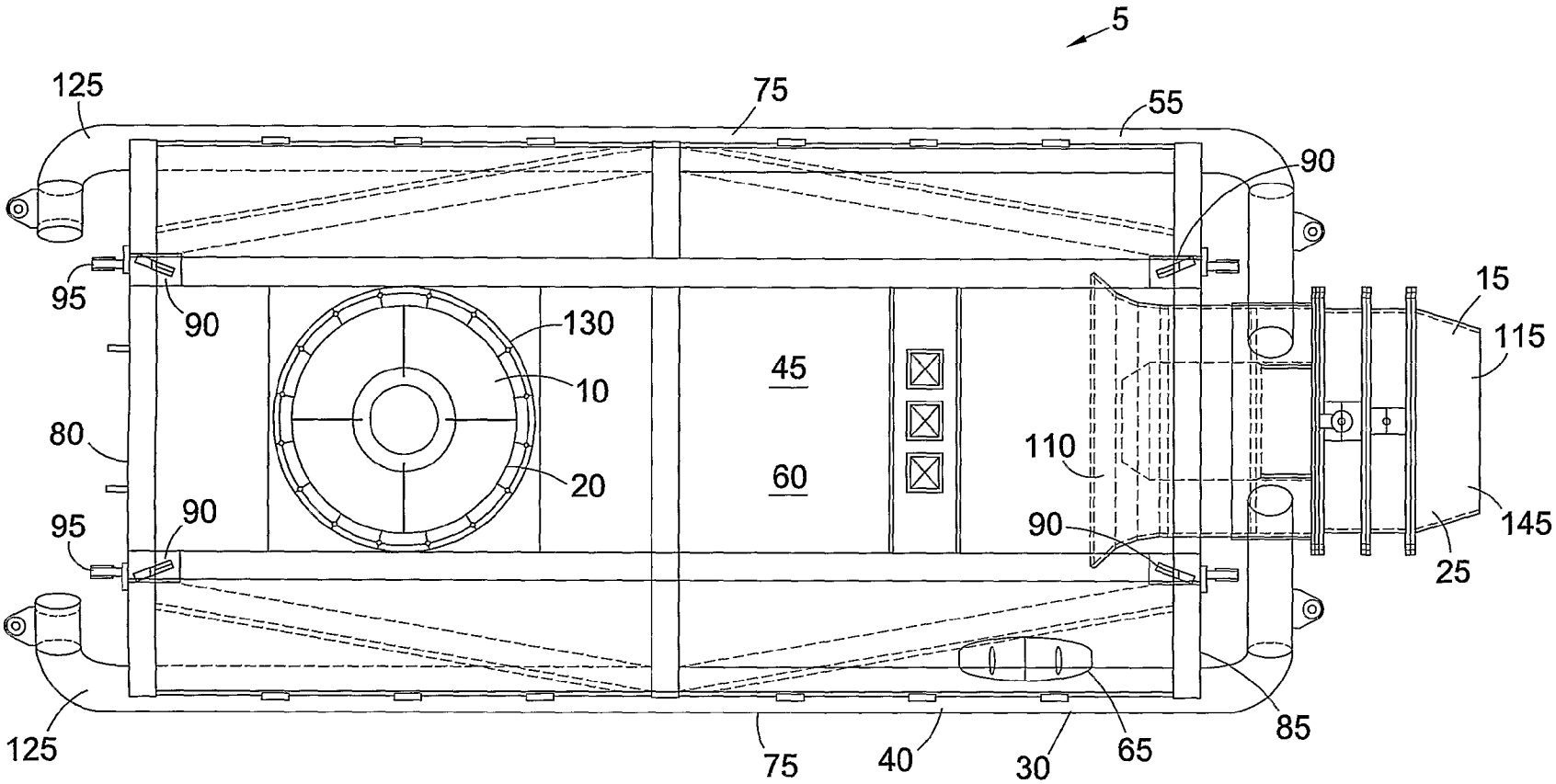
FIG. 3 a partial cross-sectional top view of the excavation apparatus of FIG. 1.

Referring initially to FIGS. 1 to 4, there is shown an excavation apparatus, device, or tool, particularly an underwater excavation apparatus, device, or tool, generally designated 5, according to a first embodiment of the present invention.

The excavation apparatus 5 comprises: means 10 for disturbing or excavating an underwater location, such as a sea bed, ocean floor or river bed; and means 15 for extracting or sucking excavated material (suction means) from the location to another location. The disturbing or excavating means 10 comprise mass flow excavation means or mass flow means 20. The suction means 15 comprise suction or collection means or further mass flow means 25.

The mass flow means 20 comprise means for blowing or directing fluid, e.g. at a predetermined or selected location to be excavated. The fluid comprises underwater fluid, e.g. from the body of water under or within which the location is positioned. In use, the mass flow means 20 disturbs or disrupts material(s) at and/or around the location. The disrupted material(s) is referred to as spoil.

The apparatus 5 comprises means 30 for restricting spoil and/or directing spoil to the suction means 25. The restricting/directing means 30 comprises a baffle or hood 35. The hood 35 comprises part of a housing, enclosure or cowling 40 which defines a space or cavity 45. The housing 40 comprises a closed top 50 which comprises the baffle or hood 35.

The housing 40 comprises a side wall or walls or skirt 55, which depend downwardly from the top 50. The housing 40 also comprises a base 60 which is at least partly open. In this way the housing 40 can be positioned, in use, such that the housing 40 rests on or above the location, and spoil removed from the location via the base 60 into the space 45 by the action of the mass flow means 20.

The housing 40 is typically made from a sheet material, e.g. sheet metal. The housing 40 comprises a skeleton or frame 61 for the sheet material. The housing 40 has an access means 65, e.g. hatch or door, e.g. in a side wall thereof. Such access means 65 allows access to the space 45, e.g. on shore, above surface and/or below surface.

The housing 40 comprises a planar, e.g. substantially rectangular, top 50. The housing 40 comprises a planar, e.g. substantially rectangular, base 60. The top 50 is, in use, positioned above the base 60. The top 50 is in this embodiment smaller than the base 60. This makes the housing 40 more stable, in use. The housing 40 comprises first and second opposing side walls 70,75, which taper outwardly from the top 50 to the base 60. The housing 40 comprises third and fourth opposing side walls 80,85, which depend substantially vertically between the top 50 and the base 60. The first and second side walls 70,75 are longer than the third and fourth side walls 80,85. In use, a direction of possible or intended movement of the apparatus 5 along or adjacent the sea bed is substantially parallel to longitudinal axes of the first and second side walls 70,75.

The apparatus 5 comprises means 90 for moving the apparatus 5 substantially vertically comprising padeyes and/or means 95 for moving the apparatus 5 substantially horizontally comprising further padeyes.

An inlet 100 of the mass flow means 20 is located external of the housing 40. An outlet 105 of the mass flow means 20 is located internal of the housing 60; in this embodiment in a lower portion of the space 45.

An inlet 110 of the suction means 25 is located internal of the housing 40. An outlet 115 of the suction means 25 is located external of the housing 40. As can be seen from FIG. 1, the inlet 100 of the mass flow means is provided nearer the base 60 than is the inlet 110 of the suction means 25.

A screen or filter 120 is provided between the mass flow means 20 and the suction means 25, e.g. between the outlet 105 from the mass flow means 20 and the inlet 110 of the suction means 25. A face or side 121 of the screen 120 closer to the mass flow means 20 faces at least partially downward or is inclined towards the base 60.

The apparatus 5 comprises means 125 for facilitating movement of the apparatus 5 such as skis, skids or runners, which are provided on the housing 40, e.g. at, on, or adjacent the base 60.

The mass flow means 20 are, at least in use, substantially vertically disposed, and in this embodiment positioned on the top 50 of the housing 40. Further, in this embodiment the suction means 25 are, at least in use, substantially horizontally disposed on a side of the housing 40, i.e. on the fourth side wall 85.

Figure 4:
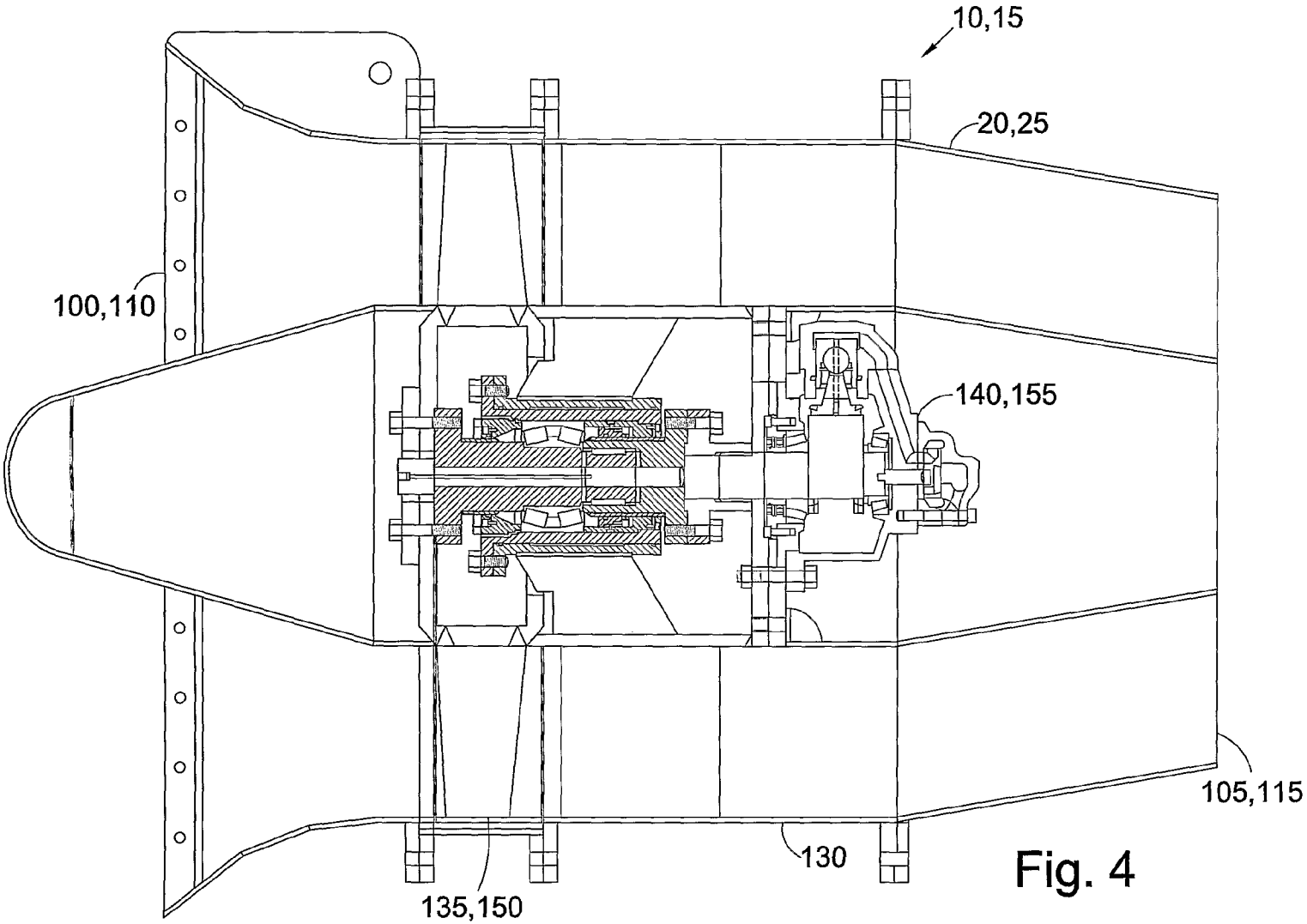
FIG. 4 a cross-sectional side view of a mass flow excavation means or suction means of the excavation apparatus of FIG. 1.

As can best be seen from FIG. 4, the mass flow means 20 comprises a hollow body 130 having the inlet 100, the outlet 105, at least one impeller 135 rotatably mounted in the hollow body 130 and means 140 for driving the at least one impeller 135.

In one alternative implementation the mass flow means 10 comprises a device comprising a hollow body having an inlet and an outlet, at least one pair of impellers coaxially displaced one from the other and rotatably mounted in the hollow body and means for driving the impellers of the/each pair in contrary rotating directions. Such a device is disclosed in GB 2 297 777 A, the content of which is incorporated herein by reference.

The inlet and outlet of the hollow body can be provided at opposing ends thereof, the common axis of the impellers extending between the inlet and the outlet.

The means for driving the impeller(s) can comprise a motor. The motor can be selected from one of: preferably a "Moineau" motor, a hydraulic motor, or alternatively, an electric motor.

In another alternative implementation the mass flow means 10 comprises a hollow body having at least two inlets and at least one outlet, at least one pair of impellers rotatably mounted in the hollow body, and means for driving the impellers, wherein the at least two inlets are substantially symmetrically disposed around an axis extending from the at least one outlet. Such a device is disclosed in EP 1 007 796 B1, the content of which is incorporated herein by reference. The driving means can cause the impellers to be driven in contrary rotating directions. One of the impellers can be provided within one of the inlets and another of the impellers can be provided within another of the inlets. There can be provided one pair of inlets.

The mass flow means can comprise a pair of horizontally opposed inlets communicating with a single outlet, the outlet being disposed substantially midway between and perpendicular to the two inlets, in use, such that the means is substantially "T" shaped in profile.

Alternatively the mass flow means can comprise a pair of inlets communicating with a single outlet, the inlets being substantially symmetrically disposed around an axis extending from the outlet, the outlet being disposed substantially midway between the two inlets, in use, such that the means is substantially "Y" shaped in profile.

The at least one impeller can be provided within the or each inlet of the mass flow means.

Referring again to FIG. 1, the/each suction means (15) comprises a hollow body 145 having the inlet 110 and the outlet 115, at least one impeller 150 rotatably mounted in the hollow body and means 155 for driving the at least one impeller 150.

The/each suction means 15 is typically of a similar structure to the mass flow means 20—e.g. as shown in FIG. 4.

In one alternative implementation the suction means 15 comprises a device comprising a hollow body having an inlet and an outlet, at least one pair of impellers coaxially displaced one from the other and rotatably mounted in the hollow body and means for driving the impellers of the/each pair in contrary rotating directions.

The inlet and outlet of the hollow body can be provided at opposing ends thereof, the common axis of the impellers extending between the inlet and the outlet.

The means for driving the impellers typically comprise a motor. The motor can be selected from one of: preferably a "Moineau" motor, a hydraulic motor, or alternatively, an electric motor.

In another alternative implementation the suction means 15 alternatively comprises a hollow body having at least two inlets and at least one outlet, at least one pair of impellers rotatably mounted in the hollow body, and means for driving the impellers, wherein the at least two inlets are substantially symmetrically disposed around an axis extending from the at least one outlet.

The driving means can cause the impellers to be driven in contrary rotating directions. One of the impellers can be provided within one of the inlets and another of the impellers may be provided within another of the inlets. There can be provided one pair of inlets.

The suction means can comprise a pair of horizontally opposed inlets communicating with a single outlet, the outlet being disposed substantially midway between and perpendicular to the two inlets, in use, such that the means is substantially "T" shaped in profile.

Alternatively the suction means can comprise a pair of inlets communicating with a single outlet, the inlets being substantially symmetrically disposed around an axis extending from the outlet, the outlet being disposed substantially midway between the two inlets, in use, such that the means is substantially "Y" shaped in profile.

The at least one impeller can be provided within the or each outlet of the suction means.

In use, the suction means 25 can act or operate at a higher flow rate than the mass flow means 20. For example, in a beneficial implementation the suction means 25 can operate at approximately double the flow rate of the mass flow excavation means 20.

The mass flow rate of the mass flow means may be typically at least 2,000 litres/second, and typically in the range of 2,000 to 16,000 litres/second.

The mass flow rate of the suction means may be typically at least 2,000 litres/second, and more typically in the range of 2,000 to 16,000 litres/second.

The pressure of flow from the mass flow means 20 is less than $6.89\times10^5$ Pa (100 psi), preferably less than $3.44\times10^5$ Pa (50 psi), e.g. in the range $3.44\times10^4$ to $1.72\times10^5$ Pa (5 to 25 psi), and most typically in the range $6.89\times10^4$ to $1.37\times10^5$ Pa (10 to 20 psi).

The pressure of flow into the suction means 25 is less than $6.89\times10^5$ Pa (100 psi), e.g. less than $3.44\times10^5$ (50 psi), e.g. in the range $3.44\times10^4$ to $1.72\times10^5$ Pa (5 to 25 psi), and typically in the range $6.89\times10^4$ to $1.37\times10^5$ Pa (10 to 20 psi).

In use, the action of the mass flow means 20 acts to reduce a size of spoil or distributed material, e.g. particulate thereof. The hood 35/housing 40 and a/the filter screen 120, in use, co-act with the mass flow means 20 and suction means 25, such that the mass flow means 20 disturbs and causes recirculation and reduction in size of spoil or disturbed material within the hood 35 and housing 40. This acts to seek to make spoil or disturbed material small enough to pass through the screen or filter 115, and advantageously of a maximum predetermined size to make the spoil suitable for transportation along a transport means.

In this embodiment the housing 40 and space 45 are rectilinear. However, in a modification the housing 40 and/or space 45 can be domed in shape.

The mass flow means 20 produces a high speed water flow, with a velocity typically in the order of 5 to 10 meters per second, being directed at the sea bed, and in doing so loosening material from the sea bed and throwing it up in the form of a precipitating cloud around the mass flow means 20.

The mass flow means 20 comprises a propeller or impeller pump means as hereinbefore described, or can be a (large) centrifugal pump type, or a combination thereof. The mass flow means 20 is typically driven by hydraulic motor means, or alternatively, an electric motor means. The inlet of the mass flow means 20 tool is on the outside of the hood 35 and the mass flow means 20 outlet or exhaust is under the hood 35.

The invention provides a means whereby the aforementioned cloud around the mass flow means 20 is captured under housing 40 which contains the mass flow means 20. The housing 40 is suspended on a cable (S) (not shown) via padeyes 90 controlling the height and position of the housing 40 above the location where a cavity is to be created. The housing 40 can be pulled along the sea bed with further cables (not shown) secured to pulling padeyes 151, and for this purpose the housing 40 is provided with skis or runners 152.

Also connected to the housing 40 is suction means 25, i.e. additional pump means, which can also be in the form of a propeller or centrifugal pump means or combination thereof, with its inlet (110) connected to or communicable with the space 45 under the housing 40 to ingest the disturbed sea bed material, and an exhaust or outlet 115 connected to a hose or pipe in order to transport the disturbed material to another location away from or remote from the space or cavity 45 at a distance controlled by the length of the hose which can exhaust to a second location on the sea bed or into a hopper or barge means on the water surface for further transport. The hose can be of a lay flat type which can be moved into position by divers or may be of a rigid construction. The hose can be buoyant, in order to float on the water surface, or it can be negatively buoyant in order to sit on the sea bed.

It is understood that most suction means 25 still have a limitation with respect to ingested particle size, and to this end screen 120 is positioned between a suction area or space and an excavating area or space within the space 45 under the hood 35 which prevents particles greater than the mesh size of the screen 120 from being ingested by the suction means 25. Generally particles greater than 70 mm are captured by the screen 120 and so prevented from entering the suction means 25. As can be seen from FIG. 1, the screen 120 is positioned at an angle in such a manner that when the suction means 25 is temporarily stopped the particles caught by the screen 120 will fall harmlessly back into the space 45. In the case of larger particles being clumped clay or sand/clay aggregate, it is intended that the subsequent circulation caused by the excavation apparatus or tool 5 will break up the aforementioned particles until they are at the size that will pass through the screen 120 for subsequent removal and transport by the suction means 25.

It will be understood that the housing 40 or hood 35 can be of a variety of shapes, such as dome shaped or rectangular, and that the housing 40 or hood 35 can be made of steel or high strength plastics, and that the housing 40 or hood 35 can be supported by support members, i.e. skeleton or frame 61. The hood 35 is provided with an access hatch 65 to allow personnel to access the inside of the housing 40 or hood 35, and particularly the inlet 110 of the suction means 25 for maintenance.

It will also be understood that there may be one or more mass flow means 20 introducing water into the hood 35 and one or more suction means 25 extracting water from under or within the hood 35. While in the beneficial disclosed embodiment the mass flow means 20 is the sole excavation means 10, it is also possible to introduce additional higher velocity jets of water in order to break up harder or stiffer clays, such as clays of 70 to 100 kPa or higher. For harder soils it is also possible to use a mechanical means or agitator to disturb the sea bed for suspension in the fluid under the hood 35.

It will be understood that, in order to transport the excavated material along the transportation pipe, the ratio of sea bed to water being transported should advantageously not exceed a ratio of approximately 15% to 20% solids to water. This ratio can be controlled by varying the power supplied to a mass flow pump and the power supplied to a suction pump.

To transport material over long distances, say 200 meters or further, it may be necessary to add another suction pump in series with suction means 25 to overcome pressure losses in the transportation pipe. The additional pumps can be directly coupled after the first suction pump 25 or can be some distance along the transportation pipe.

In order to minimise damage caused by abrasion and wear of impellers and guide vanes of the mass flow means 20 and suction means 25, the impellers and guide vanes can be made of a hard material or a material with a hard coating such as nitride coating or tungsten carbide coating.

Figure 5:
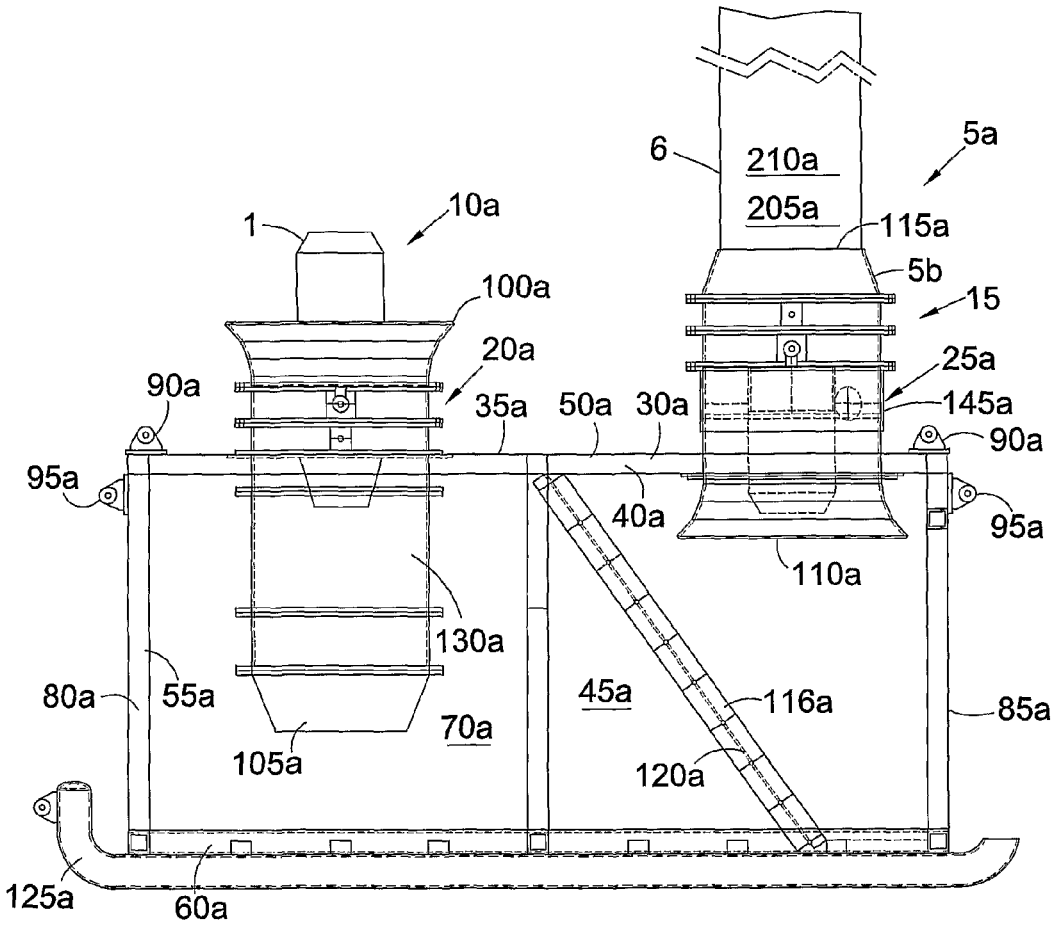
FIG. 5 a partial cross-sectional side view of an excavation apparatus according to a second embodiment of the present invention.

Referring now to FIG. 5 there is shown an excavation apparatus, generally designated 5*a*, according to a second embodiment of the present invention.

The excavation apparatus 5*a* is similar to the excavation apparatus 5 of the first embodiment, like parts being denoted by like numerals, but suffixed "a".

In this second embodiment the suction means 25*a* is substantially vertically disposed on the top 50*a* of the housing 40*a*. This can be suitable for excavation of deep cavities and vertical lifting of disturbed material or spoil.

Figure 6:
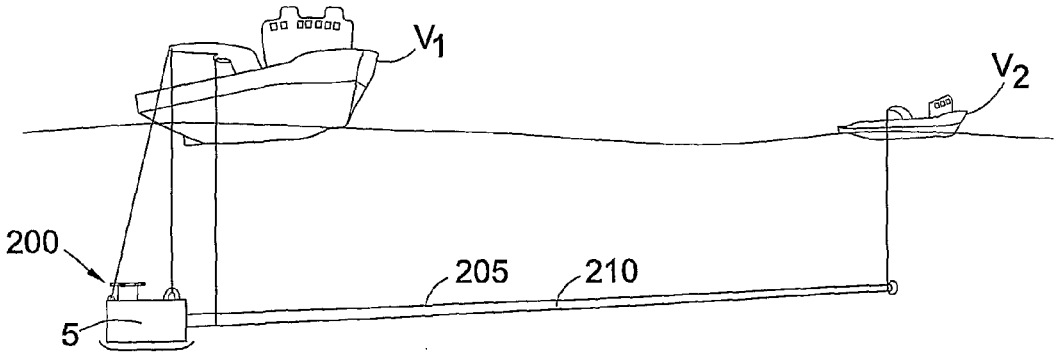
FIG. 6 a schematic perspective view of an underwater excavation system according to the present invention, in use.

Referring now to FIG. 6 there is shown an underwater excavation system generally designated 200, comprising:

at least one apparatus 5; 5*a* according to FIGS. 1 to 4 or FIG. 5; and means 205 for transporting spoil from the suction means 25 to a remote location $L_R$.

The transport means 205 comprises a pipe or hose 210. The hose 210 is typically a collapsible or lay flat hose, e.g. handlable by divers. The transport means 205 optionally comprises at least one further suction means (not shown) positioned along the transport means 205.

In one implementation the remote location $L_R$ comprises a location on the sea bed, ocean floor, lake floor, or river bed, or the like, e.g. below the level of the location being excavated. This is particularly beneficial in seeking to obviate or mitigate refilling of the excavated location. Alternatively, the remote location can comprise a vessel, e.g. barge or hopper.

In use the invention also provides a method of excavating the underwater location, comprising:

providing the system 200;

using the system 200 to move material from the location $L_E$ to a remote location $L_R$.

Figure 7:
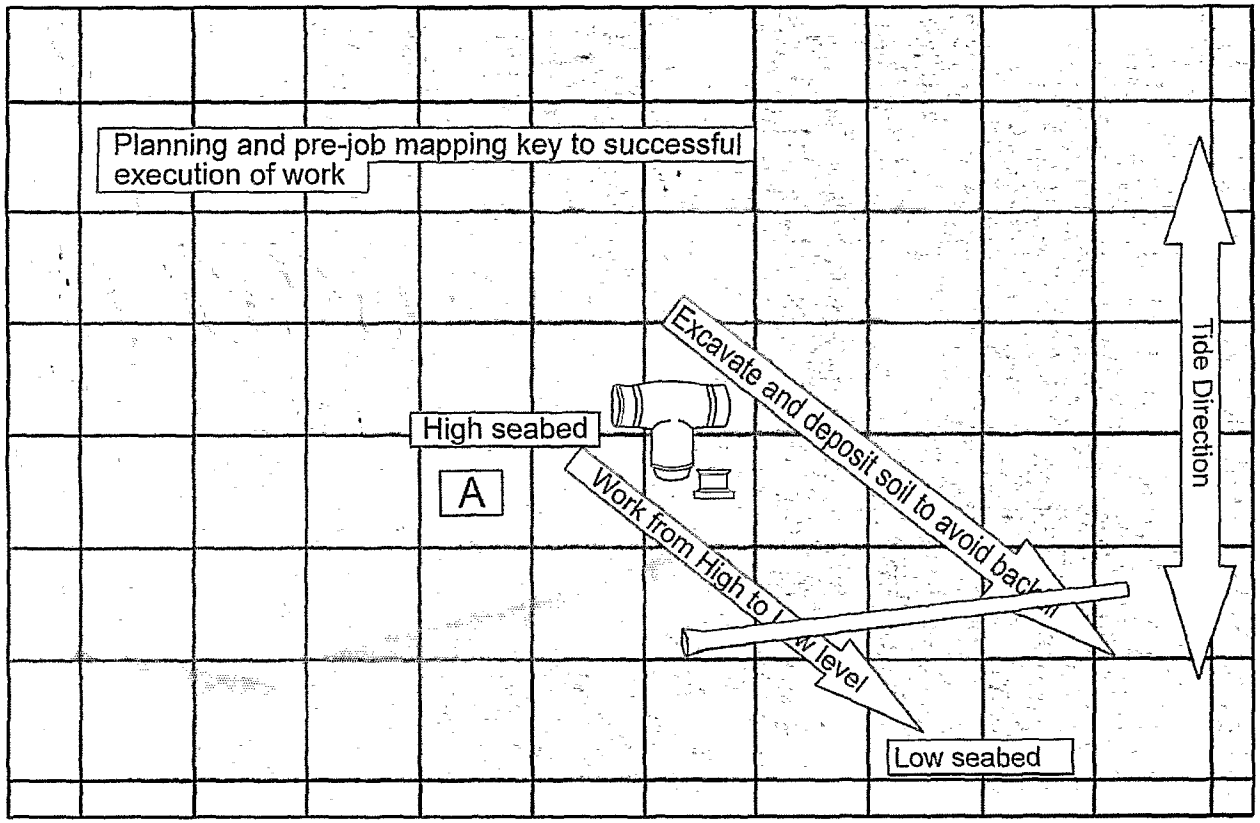
FIG. 7 a schematic diagram of an excavation area divided into sectors.
Figure 8:
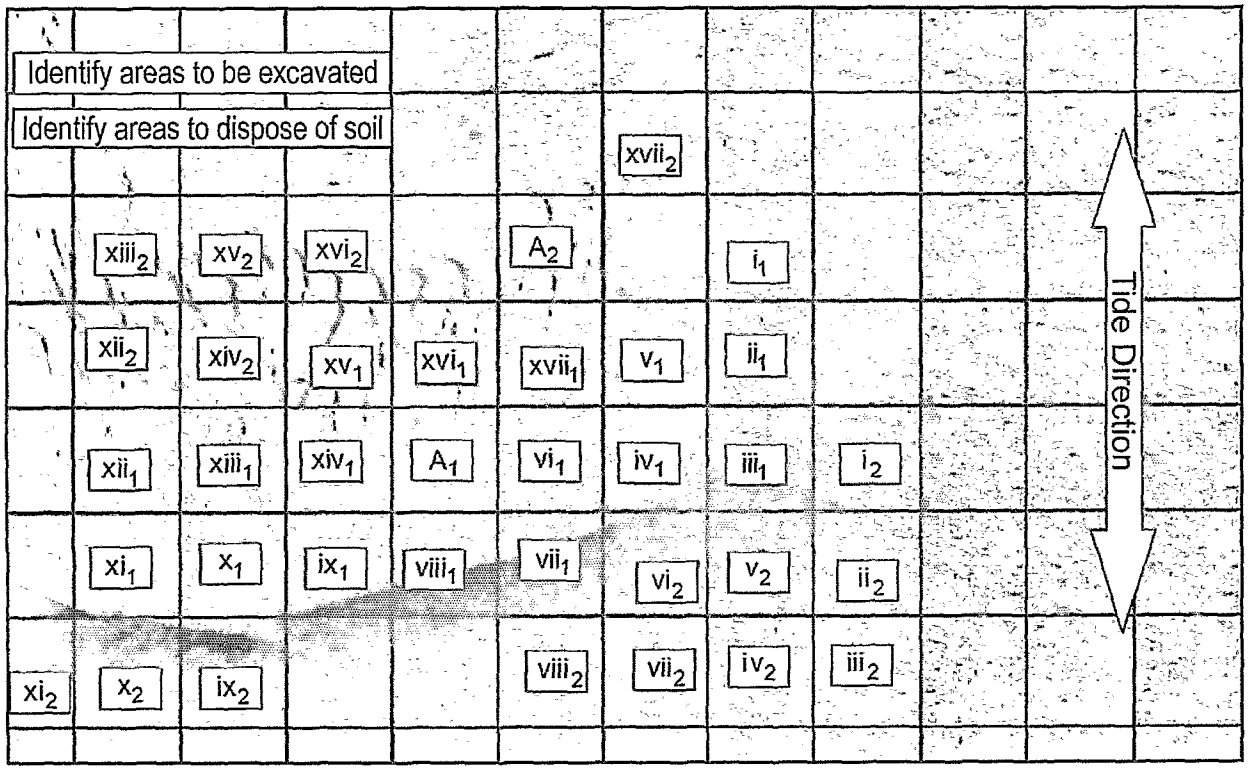
FIG. 8 a further schematic diagram of the excavation area of FIG. 7 divided into sectors.
Figure 9:
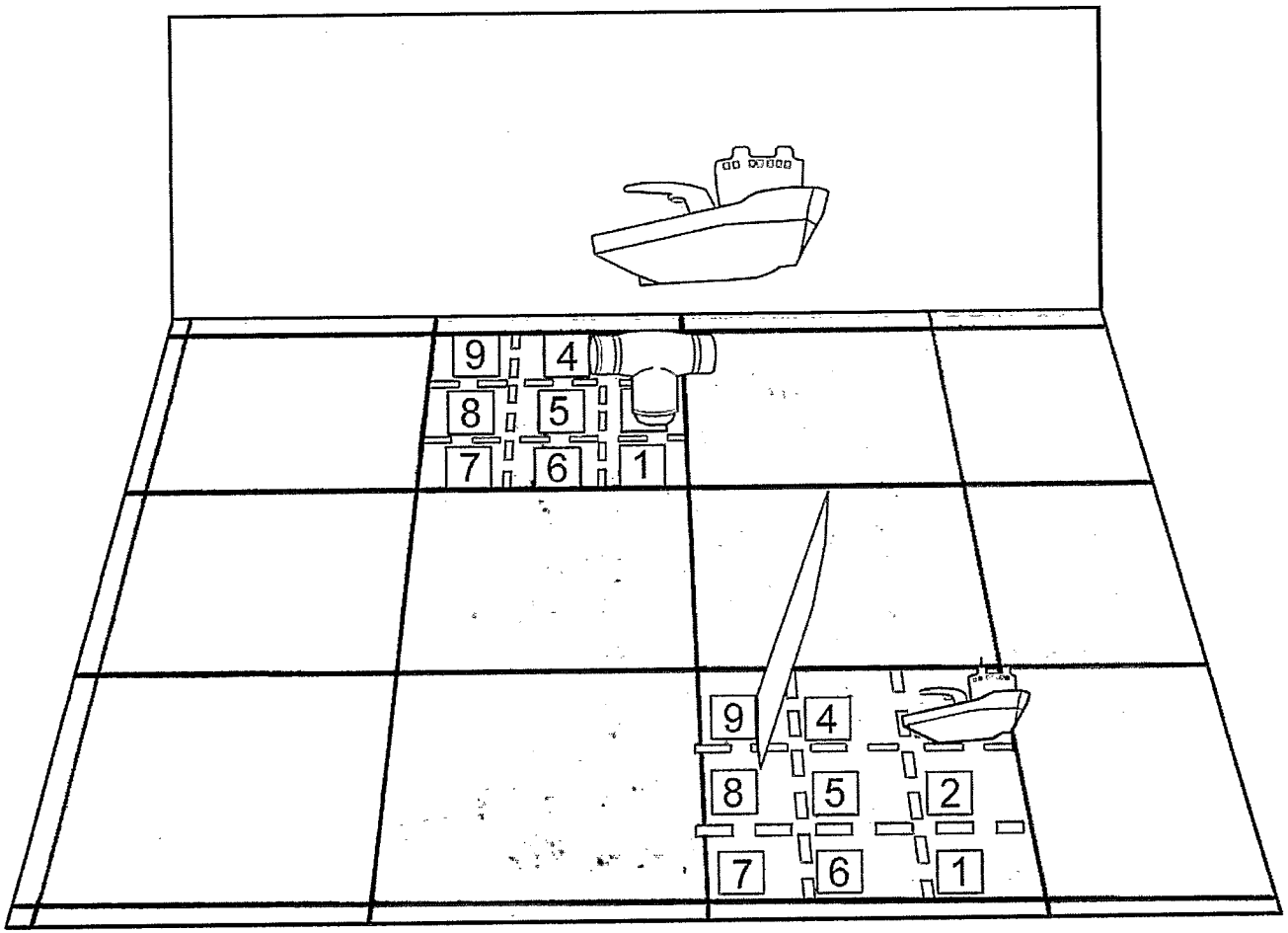
FIG. 9 a further schematic diagram of the excavation area of FIG. 7 subdivided into sub sectors.

Referring now to FIGS. 7 to 9, there is exemplified a method of excavating an underwater location $L_E$ comprising: surveying the location $L_E$; excavating the location $L_E$.

The step of surveying the location $L_E$ comprises dividing the location and the environs thereof into a plurality of sectors, e.g. grid sectors, A; $i_1$, $ii_1$ . . . ; $i_2$, $ii_2$, . . . .

The step of surveying also comprises establishing a height, e.g. an average height, of a surface or position, e.g. sea bed, ocean floor, lake floor, or river bed, or the like within at least a sector $i_1$ in which the location lies and at least one and preferably a plurality of another sector(s) $i_2$. The step of surveying comprises selecting one of the another sectors $i_2$ distal or remote from the location sector i1, i.e. not adjacent thereto, which another sector $i_2$ has a lower height than the location sector $i_1$.

Also the step of selecting the one another sector $i_2$ comprises selecting the another sector $i_2$ dependent upon said another sector $i_2$ being in a non direct or diagonally downstream disposition or diagonally downstream disposition of the location sector $i_1$ in one tidal stream direction.

The method also comprises providing an excavation apparatus 5, and excavating the location $L_E$ with the excavation apparatus 5.

The step of excavating the location $L_E$ comprises using the excavation apparatus 5 to remove material or spoil from the location sector $i_1$ to the selected another sector $i_2$.

The method typically comprises repeating the steps of the method for a plurality of locations in a plurality of sectors $ii_1$, . . . . In such case, each another location can be different and/or the same.

In use, to remove excavated sea bed material, the excavation system 200 is deployed to the sea bed 300 from a vessel $V_1$. The hose 210 can be a lay flat type, and can be rolled out sub sea by divers. A discharge diffuser with a handle or ROV latch (not shown) can be fitted to the discharge end of the hose 210. After the hose 210 has been laid out, and divers have confirmed that the discharge lines are flowing freely, the excavation apparatus 5 can be powered up and excavation commenced. A work boat $V_2$ can be used to move a discharge end of the hose 210. Prefabricated saddles (not shown) can be deployed beneath the hose 210 at intervals, for example, of approximately 100 metres, to assist with hose 210 movement and handling.

Planning and pre-job mapping of the area surrounding the location $L_E$ to be excavated is key to successful excavation work. The area is divided into a plurality of sectors $i_1$, $ii_1$ . . . ; $i_2$, $ii_2$, . . . by a grid. The tidal direction is determined, a topography of the area is determined, and a plan of material movement from a sector $i_1$ to sector $i_2$ etc is planned.

As shown in FIGS. 7 to 9, the respective sectors are spaced from one another and diagonally displaced from one another in relation to tidal direction. Further, the sector $i_2$ to which the material is removed is most preferably at a lower level than the sector $i_1$ from which the material is removed. By this method, efficient movement of material is provided and back filling of excavated obviated or mitigated.

Referring to FIG. 9, each of the sectors $i_1$, $ii_1$ . . . ; $i_2$, $ii_2$, . . . can be further sub divided into sub sectors in a modified implementation of the method of excavation, if so desired.

Pumps of the mass flow means 20 and suction means 25, can operate at around at least 2,000 litres per second, and typically, up to a maximum of 8,000 litres per second. Spoil transportation rates are dependent upon a number of factors, particularly spoil characteristics. Tons of spoil pumped per minute are dependent upon volume achieved. For example, for soil by volume percentage 5, 10 and 15%, tons of soil pumped per minute for pumps of 2,000 litres per second would be in the region of 6, 12, or 18 tons of soil pumped per minute.

Figure 10:
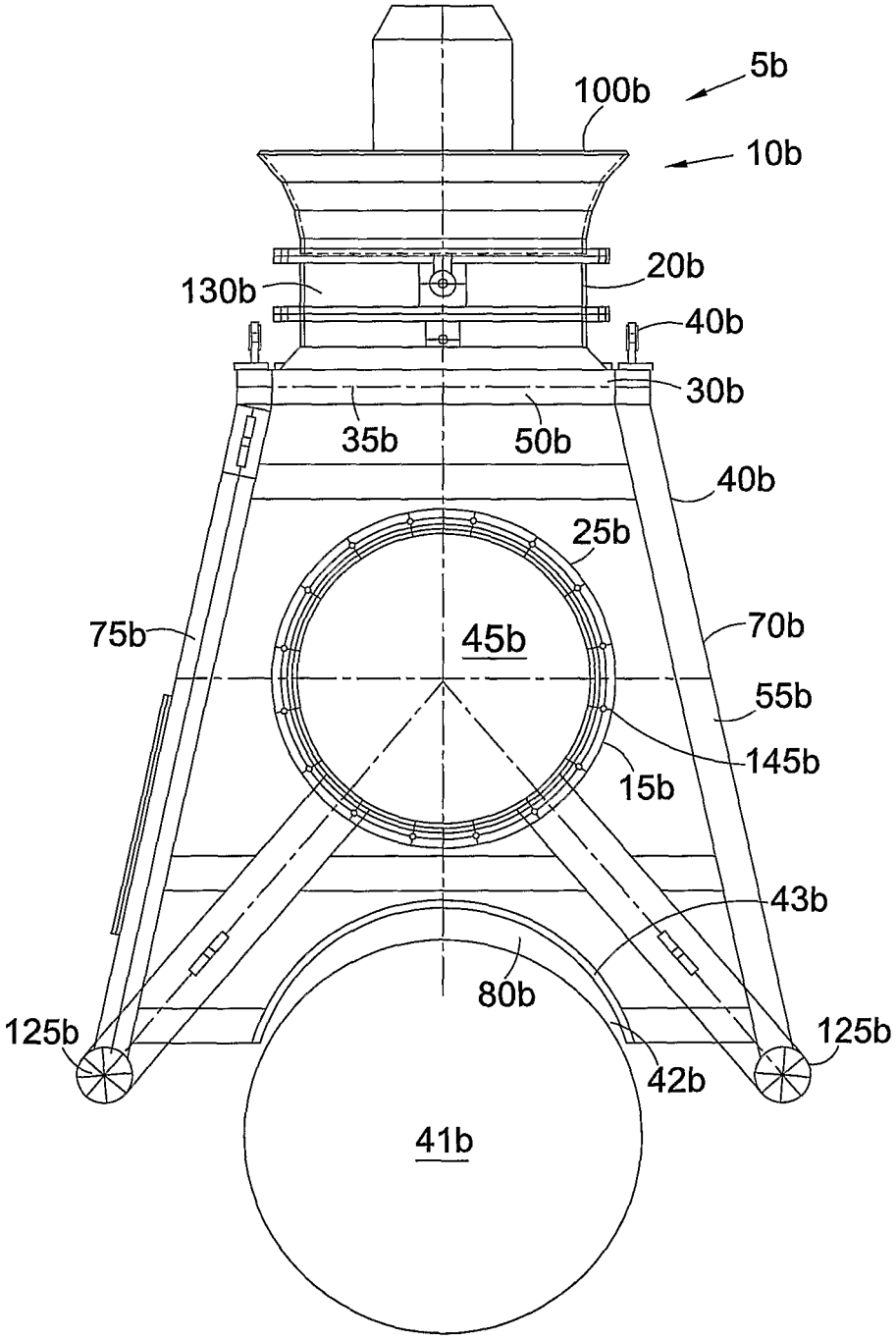
FIG. 10 an end view of an excavation apparatus according to a third embodiment of the present invention.

Referring now to FIG. 10, there is shown an end view of an excavation apparatus generally designated 5*b*, according to a third embodiment of the present invention. The excavation apparatus 5*b* is similar to the excavation apparatus 5 of the first embodiment, like parts being denoted by like numerals, but suffixed "b".

In this third embodiment the housing 40*b* is adapted to at least partially fit over at least a portion of a pipe 41*b* to be, or which is, being excavated or deburied. A pair of apertures 42*b* are provided in the third and fourth side walls 80*b*, 85*b* of the housing 40*b*. The apertures 42*b* are transversely aligned with one another, extend from the base 60*b* of the housing 40*b* and are substantially U-shaped.

This arrangement allows the housing 40*b* to be moved along the pipe 41*b* as excavation thereof progresses. The pipe 41*b* typically will have an outer diameter in the range 8 inches (20.32 cms) to 42 inches (106.68 cms).

Each aperture 42*b* is provided with a peripheral sealing means 43*b*.

The sealing means 43*b* act to seal between the housing 40*b* and the pipe 41*b*, in use, so as to improve the efficiency of the excavation apparatus 5*b*.

At least a portion of transportation means or pipe (not shown) extending from the suction means 15*b* can, in use, extend or trail rearward of a direction of movement of the housing 40*b*.

It will be appreciated that the embodiments of the present invention hereinbefore described are given by way of example only, and are not meant to limit the scope of the invention in any way. Further, any features of the invention recited in the Summary of Invention may form part of the disclosed embodiments.

The disclosed embodiments provide an apparatus or tool, such as an excavation apparatus or tool, such as an underwater excavation apparatus or tool, comprising:

a first mass flow means; and a second mass flow means.

The first mass flow means may direct or cause flow, e.g. of fluid, towards a location to be excavated. The second mass flow means may direct or cause flow, e.g. of spoil, away from the location. The apparatus or tool may also comprise a housing. The first mass flow means can be referred to as a "blowing" means. The second mass flow means can be referred to as a "sucking" or "suction" means.

The invention claimed is:

1. An underwater excavation apparatus comprising:

at least one mass flow means for directing fluid at a selected location to be excavated;

at least one suction means; and a housing, wherein an inlet of the mass flow means is located external of or is communicable with external of the housing, and an outlet of the mass flow means is located internal of or is communicable with internal of the housing, and wherein an inlet of the suction means is located internal of or is communicable with internal of the housing, and an outlet of the suction means is located external of or is communicable with external of the housing.

2. An underwater excavation apparatus as claimed in claim 1, wherein the mass flow or fluid comprises underwater fluid.

3. An underwater excavation apparatus as claimed in claim 1, wherein, in use, mass flow from the mass flow means disturbs or disrupts material(s) at and around the location.

4. An underwater excavation apparatus as claimed in claim 1, wherein the apparatus comprises means for restricting spoil and directing spoil to the suction means.

5. An underwater excavation apparatus as claimed in claim 1, wherein the apparatus comprises a baffle or hood.

6. An underwater excavation apparatus as claimed in claim 1, wherein the housing comprises a space or cavity.

7. An a underwater excavation apparatus as claimed in claim 6, wherein the housing comprises a closed top.

8. An underwater excavation apparatus as claimed in claim 6, wherein the housing is made from a sheet material and comprises a skeleton or frame.

9. An underwater excavation apparatus as claimed in claim 6, wherein the housing comprises an access means such as a hatch or door.

10. An apparatus as claimed in claim 6, wherein the housing comprises a base which is at least partly open, the housing being positioned, in use, so that the housing rests on or above the location and spoil can be removed from the location via the base into the space or cavity by the action of the mass flow means.

11. An apparatus as claimed in claim 6, wherein the housing comprises a planar substantially rectangular top, and a planar substantially rectangular base positioned above the base.

12. An underwater excavation apparatus as claimed in claim 1, wherein the apparatus or tool comprises means for moving the apparatus substantially vertically and means for moving the apparatus substantially horizontally.

13. An underwater excavation apparatus as claimed in claim 6, wherein the outlet of the mass flow means is provided in a lower portion of the space.

14. An underwater excavation apparatus as claimed in claim 6, wherein the outlet of the mass flow means is nearer the base than the inlet of the suction means.

15. An underwater excavation apparatus as claimed in claim 1, wherein a screen or filter is provided between the mass flow means and the suction means.

16. An underwater excavation apparatus as claimed in claim 15, wherein a face or side of the screen closer to the mass flow means faces at least partially downward or is inclined towards a base.

17. An underwater excavation apparatus as claimed in claim 1, wherein the apparatus comprises means for facilitating movement of the apparatus such as skis, skids or runners, which are provided on a housing.

18. An underwater excavation apparatus as claimed in claim 1, wherein the mass flow means is substantially vertically disposed.

19. An underwater excavation apparatus as claimed in claim 1, wherein the suction means is substantially horizontally disposed.

20. An underwater excavation apparatus as claimed in claim 1, wherein the suction means are substantially vertically disposed.

21. An underwater excavation apparatus as claimed in claim 1, wherein the mass flow means comprises a hollow body, having an inlet and an outlet, at least one impeller rotatably mounted in the hollow body and means for driving the at least one impeller.

22. An underwater excavation apparatus as claimed in claim 1, wherein the mass flow means comprises a device comprising a hollow body having an inlet and an outlet, at least one pair of impellers coaxially displaced one from the other and rotatably mounted in the hollow body and means for driving the impellers of the/each pair in contrary rotating directions.

23. An underwater excavation apparatus as claimed in claim 1, wherein the suction means comprises a hollow body having an inlet and an outlet, at least one impeller rotatably mounted in the hollow body and means for driving the at least one impeller.

24. An underwater excavation apparatus as claimed in claim 23, wherein the or each suction means comprises a hollow cylindrical body, the suction means hollow body being mounted through the housing, and an inner diameter of at least the outlet of the suction means hollow body being at least 450 mm or 660 mm or greater.

25. An underwater excavation apparatus as claimed in claim 1, wherein the suction means comprise a device comprising a hollow body having an inlet and an outlet, at least one pair of impellers coaxially displaced one from the other and rotatably mounted in the hollow body and means for driving the pair or pairs of impellers in contrary rotating directions.

26. An underwater excavation apparatus as claimed in claim 1, wherein in use, the suction means acts or operates at a higher flow rate or higher mass flow rate than the mass flow means.

27. An underwater excavation apparatus as claimed in claim 1, wherein:

a mass flow rate of the mass flow means is at least 2,000 liters/second or in the range of 2,000 to 16,000 to liters/second; and a pressure of the flow from the mass flow means is selected from one of: less than $6.89\times10^5$ Pa (100 psi), less than $3.44\times10^5$ Pa (50 psi), in the range $3.44\times10^4$ to $1.72\times10^5$ Pa (5 to 25 psi) or in the range $6.89\times10^4$ to $1.37\times10^5$ Pa (10 to 20 psi).

28. An underwater excavation apparatus as claimed in claim 1, wherein:

a mass flow rate of the suction means is at least 2,000 liters/second or in the range of 2,000 to 16,000 liters/second; and a pressure of flow into the suction means is selected from one of: less than $6.89\times10^5$ Pa (100 psi), less than $3.44\times10^5$ Pa (50 psi), in the range $3.44\times10^4$ to $1.72\times10^5$ Pa (5 to 25 psi), or in the range $6.89\times10^4$ to $1.37\times10^5$ Pa (10 to 20 psi).

29. An underwater excavation apparatus as claimed in claim 1, wherein, in use, the action of the mass flow means acts to reduce a size of spoil or disturbed material.

30. An underwater excavation apparatus as claimed in claim 1, wherein the apparatus comprises a hood and a filter or screen, and in use, the mass flow means disturbs and causes recirculation and reduction in size of spoil or disturbed material within the hood.

31. An underwater excavation apparatus as claimed in claim 6, wherein the housing is rectilinear or domed.

32. An underwater excavation apparatus as claimed in claim 1, wherein the housing is provided with means to at least particularly fit over at least a portion of a pipe, pipeline, or tubular to be or which is being excavated or deburied.

33. An underwater excavation apparatus as claimed in claim 32, wherein first and second apertures are provided in the third and fourth walls, respectively, of the housing.

34. An underwater excavation apparatus as claimed in claim 33, wherein the first and second apertures are substantially transversely aligned, extend from the base of the housing, and are substantially U-shaped.

35. An underwater excavation apparatus as claimed in claim 32, wherein the means for fitting over is/are provided with sealing means.

36. An apparatus as claimed in claim 11, wherein the top is smaller than the base, the housing further comprises first and second opposing side walls, which taper from the top to the base, and the housing comprises third and fourth opposing side walls, which depend substantially vertically between the top and the base, the first and second side walls being bigger than the third and fourth side walls, and wherein, in use, a direction of intended movement of the apparatus is substantially longitudinally parallel to the first and second side walls.

37. An underwater excavation apparatus as claimed in claim 12, wherein, in use, the apparatus is moved horizontally parallel to a longitudinal axis thereof.

38. An underwater excavation apparatus as claimed in claim 15, wherein the screen or filter is provided between an outlet from the mass flow means and an inlet of the suction means.

39. An underwater excavation apparatus as claimed in claim 21, wherein the mass flow means comprises a hollow cylindrical body, the mass flow means hollow body being mounted through the housing, and an inner diameter of the at least the outlet of the hollow body being at least 450 mm or 660 mm or greater.

40. An underwater excavation apparatus as claimed in claim 35, wherein the means for fitting over act to seal between at least a portion of the housing and at least a portion of the pipe, in use.

41. An underwater excavation system comprising:

at least one underwater excavation apparatus comprising:

at least one mass flow means for directing fluid at a selected location to be excavated;

at least one suction means; and a housing, wherein an inlet of the mass flow means is located external of or is communicable with external of the housing, and an outlet of the mass flow means is located internal of or is communicable with internal of the housing, and wherein an inlet of the suction means is located internal of or is communicable with internal of the housing, and an outlet of the suction means is located external of or is communicable with external of the housing; and means for transporting spoil from the suction means to a remote location.

42. An underwater excavation system as claimed in claim 41, wherein the transporting means comprises a pipe or hose.

43. An underwater excavation system as claimed in claim 41, wherein the transport means comprises at least one further suction means positioned along the transport means.

44. An underwater excavation system as claimed in claim 41, wherein the remote location comprises a location on the sea bed, ocean floor, lake floor, river bed, or canal bed, or the remote location comprises a vessel, such as a barge or hopper.

45. An underwater excavation system as claimed in claim 41, wherein an inlet of the transport means communicates with an outlet of the suction means and an outlet of the transport means communicates with the remote location(s).

46. An underwater excavation system as claimed in claim 42, wherein the hose is a collapsible or a lay flat hose.

47. An underwater excavation system as claimed in claim 43, wherein the transport means comprising at least one further suction means positioned along the transport means in series with the suction means.

48. An underwater excavation system as claimed in claim 44, wherein the remote location comprises a location on the sea bed, ocean floor, lake floor, river bed, or canal bed below the level of the location being excavated.

49. A method of excavating an underwater location, comprising:

providing an underwater excavation system comprising:

at least one underwater excavation apparatus comprising:

at least one mass flow means for directing fluid at a selected location to be excavated;

at least one suction means; and a housing, wherein an inlet of the mass flow means is located external of or is communicable with external of the housing, and an outlet of the mass flow means is located internal of or is communicable with internal of the housing, and wherein an inlet of the suction means is located internal of or is communicable with internal of the housing, and an outlet of the suction means is located external of or is communicable with external of the housing; and means for transporting spoil from the suction means to a remote location; and using the system to move material from the location to a remote location.

* * * * *